US008374380B2

(12) United States Patent
Tang

(10) Patent No.: US 8,374,380 B2
(45) Date of Patent: Feb. 12, 2013

(54) SPEAKER VOICE COIL STRUCTURE HAVING AT LEAST THREE COILS

(75) Inventor: Ming-Fang Tang, Taipei (TW)

(73) Assignee: Zylux Acoustic Corporation, Taipei (TW)

( * ) Notice: Subject to any disclaimer, the term of this patent is extended or adjusted under 35 U.S.C. 154(b) by 126 days.

(21) Appl. No.: 13/082,482

(22) Filed: Apr. 8, 2011

(65) Prior Publication Data

US 2012/0257784 A1 Oct. 11, 2012

(51) Int. Cl.
*H04R 9/06* (2006.01)
*H04R 11/02* (2006.01)

(52) U.S. Cl. ..... 381/409; 381/400; 381/401

(58) Field of Classification Search ..... 381/400, 381/401, 409

See application file for complete search history.

(56) References Cited

U.S. PATENT DOCUMENTS

| | | | | |
|---|---|---|---|---|
| 5,062,140 | A * | 10/1991 | Inanaga et al. | 381/399 |
| 2005/0185816 | A1 * | 8/2005 | Roark et al. | 381/400 |
| 2007/0183620 | A1 * | 8/2007 | Stiles et al. | 381/401 |
| 2008/0310669 | A1 * | 12/2008 | North | 381/409 |

* cited by examiner

*Primary Examiner* — Brian Ensey
*Assistant Examiner* — Katherine Faley
(74) *Attorney, Agent, or Firm* — Guice Patents PLLC

(57) ABSTRACT

An improved speaker voice coil structure, the structure including: a bobbin; a first voice coil, wound around the bobbin and having a first terminal and a second terminal; a second voice coil, wound around the first voice coil and having a third terminal and a fourth terminal; and a third voice coil, wound around the second voice coil and having a fifth terminal and a sixth terminal. The improved voice coil structure thereby provides multiple optional connection terminals—from different layers with different values of impedance—for an input signal.

4 Claims, 5 Drawing Sheets

SPEAKER VOICE COIL STRUCTURE HAVING AT LEAST THREE COILS

BACKGROUND OF THE INVENTION

1. Field of the Invention

The present invention relates to a voice coil structure for speaker, especially to an improved speaker voice coil structure, wherein the improved voice coil structure has at least three coils.

2. Description of the Related Art

As is well known, speaker is an energy transformer, capable of transforming electrical energy to sound energy. The operation of an electrical speaker is to transmit an audio signal of an amplifier to a speaker, and when the audio signal is applied to the speaker, a current will flow through a voice coil of the speaker, and a motive force to a paper cone will be generated by the reaction of the current to a magnetic field to produce sound.

With technology making progress, electrical speaker, after years of evolving, has become matured and common seen—it can be found in applications like PA (Public Address), home box, notebook computer, or mobile phone—and has maintained almost fixed ways of voice coil winding and input signal connection.

Please refer to FIG. 1*a* and FIG. 1*b*, which illustrate respectively a side view and a top view of a prior art voice coil structure. As is illustrated in the figures, a prior art voice coil structure 100 includes a bobbin 110 and a voice coil 120. The voice coil 120, wound around the bobbin 110, has a first terminal 121 and a second terminal 122, and can have two turns or four turns according to requirement. However, the prior art voice coil structure 100 has only one set of input terminals, so only one impedance option is provided.

Please refer to FIG. 2*a* and FIG. 2*b*, which illustrate respectively a side view and a top view of another prior art voice coil structure having two voice coils. As is illustrated in the figures, a prior art voice coil structure 200 includes a bobbin 210, a first voice coil 220 and a second voice coil 230. The first voice coil 220, wound around the bobbin 210, has a first terminal 221 and a second terminal 222. The second voice coil 230, wound around the first voice coil 220, has a third terminal 231 and a fourth terminal 232. Both of the first voice coil 220 and the second voice coil 230 can have two turns or four turns according to requirement. However, although the prior art voice coil structure 200 have two sets of input terminals, the wire of the coils can slip off the bobbin due to insufficient accommodation space when the total number of turns exceeds four. Besides, as the impedance provided between the first terminal 221 and the second terminal 222, and the impedance provided between the third terminal 231 and the fourth terminal 232 are both fixed values—can not be adjusted according to requirement, the application flexibility of the prior art voice coil structure 200 is then limited.

Therefore, there is a need to design a novel voice coil structure for speaker to overcome the mentioned disadvantages.

SUMMARY OF THE INVENTION

One objective of the present invention is to provide an improved speaker voice coil structure, the structure having at least three voice coils wound around a bobbin to offer multiple options of connection terminals for an input signal.

Another objective of the present invention is to provide an improved speaker voice coil structure, the structure having at least three voice coils wound around a bobbin to offer multiple options of connection terminals from different layers.

Still another objective of the present invention is to provide an improved speaker voice coil structure, the structure having at least three voice coils wound around a bobbin to offer multiple options of impedance.

Still another objective of the present invention is to provide an improved speaker voice coil structure to minimize the space occupied by the coils and thereby prevent wire of the coils from slipping off a bobbin.

To attain the foregoing objectives, an improved speaker voice coil structure is proposed, the structure includes: a bobbin; a first voice coil, wound around the bobbin and having a first terminal and a second terminal; a second voice coil, wound around the first voice coil and having a third terminal and a fourth terminal; and a third voice coil, wound around the second voice coil and having a fifth terminal and a sixth terminal, wherein the first terminal, the second terminal, the third terminal, the fourth terminal, the fifth terminal, and the sixth terminal are approximately evenly spaced with an angular distance seen from the center of the bobbin.

To attain the foregoing objectives, another improved speaker voice coil structure is proposed, the structure includes: a bobbin; a first voice coil, wound around the bobbin and having a first terminal and a second terminal; a second voice coil, wound around the first voice coil and having a third terminal and a fourth terminal, wherein the angle between the third terminal and the first terminal seen from the center of the bobbin and the angle between the fourth terminal and the second terminal seen from the center of the bobbin are approximately equal to a first angle; and a third voice coil, wound around the second voice coil and having a fifth terminal and a sixth terminal, wherein the angle between the fifth terminal and the third terminal seen from the center of the bobbin and the angle between the sixth terminal and the fourth terminal seen from the center of the bobbin are approximately equal to a second angle.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiment of the invention.

Figure 1B:
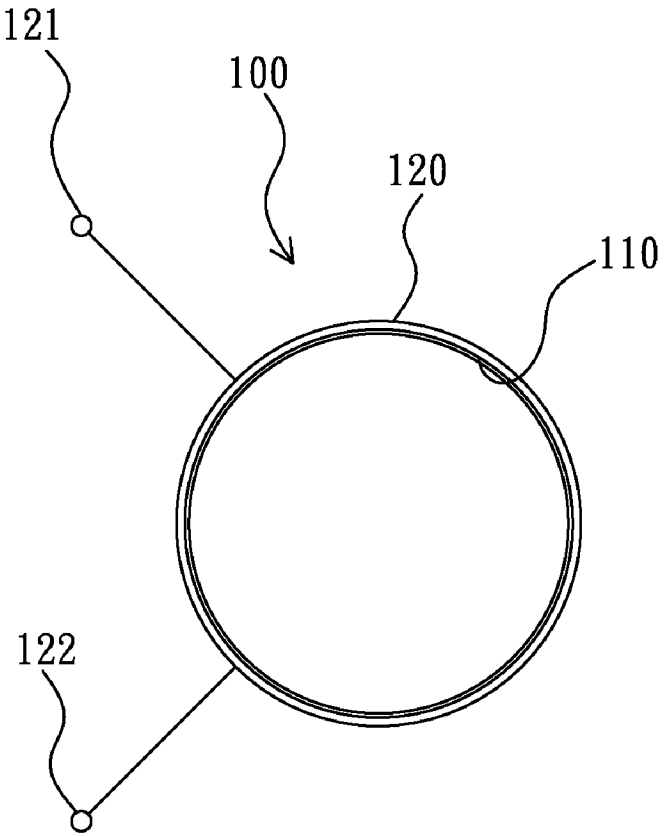
(PRIOR ART) FIG. 1b
FIG. 1*b* illustrates a top view of a prior art voice coil structure.
Figure 1A:
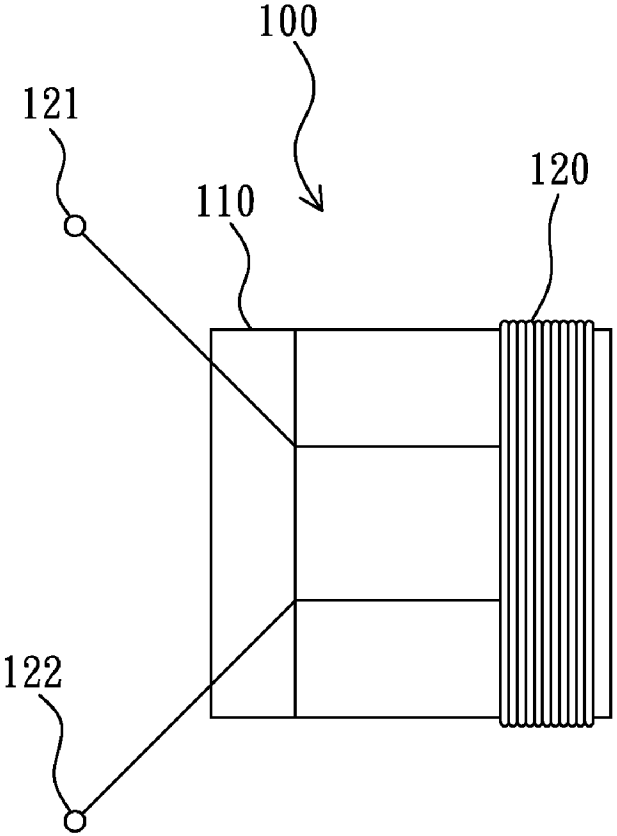
(PRIOR ART) FIG. 1a
FIG. 1*a* illustrates a side view of a prior art voice coil structure.
Figure 2B:
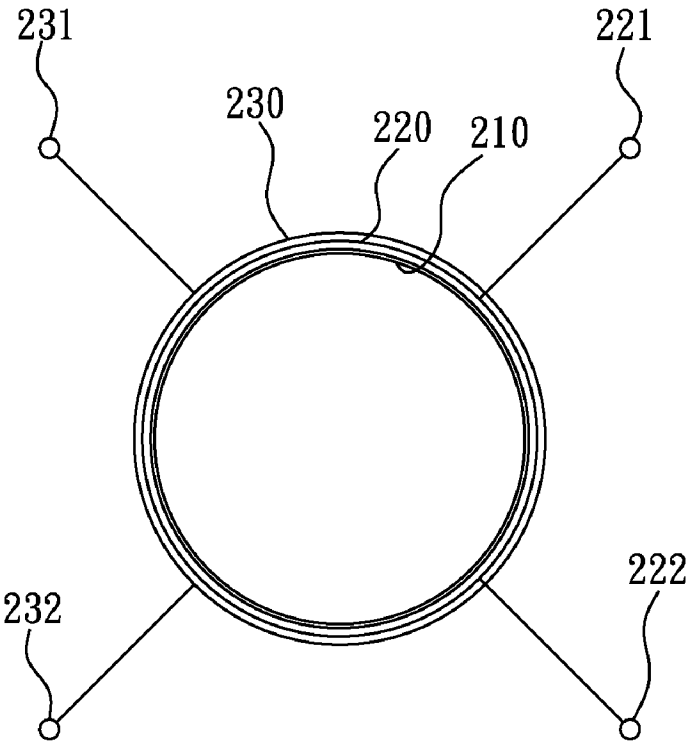
(PRIOR ART) FIG. 2b
FIG. 2*b* illustrates a top view of a prior art voice coil structure having two voice coils.
Figure 2A:
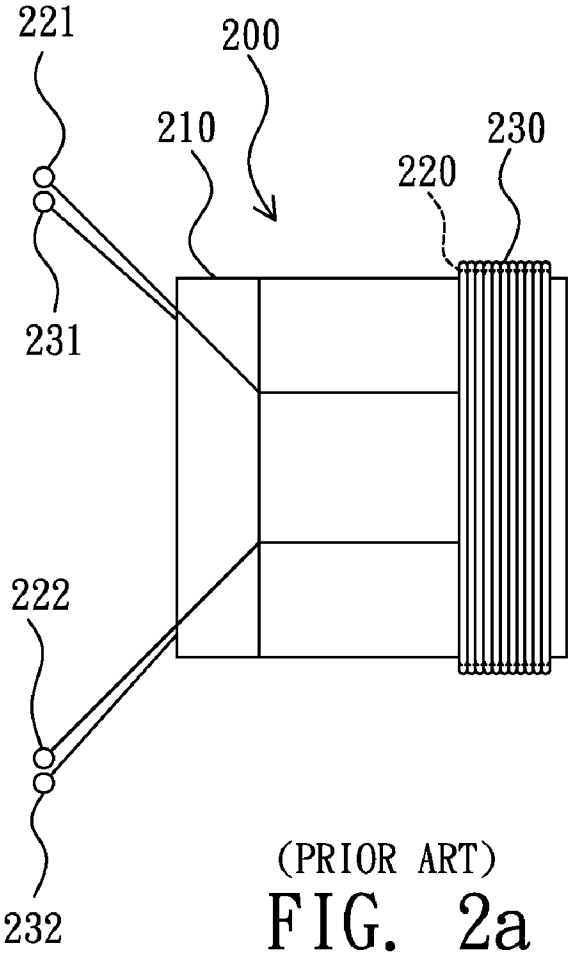
(PRIOR ART) FIG. 2a
FIG. 2*a* illustrates a side view of a prior art voice coil structure having two voice coils.
Figure 3B:
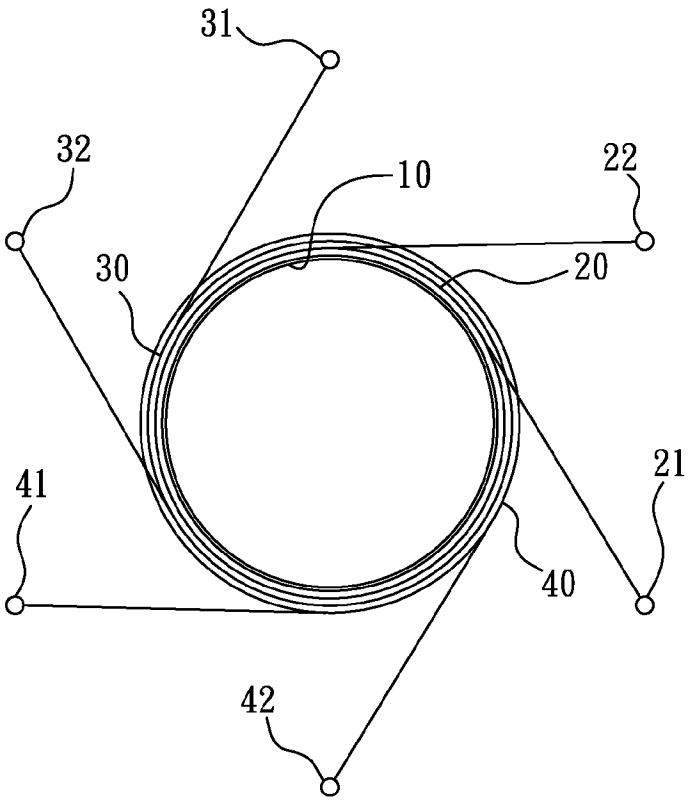
FIG. 3*b* illustrates a top view of an improved speaker voice coil structure according to a preferred embodiment of the present invention.
Figure 3A:
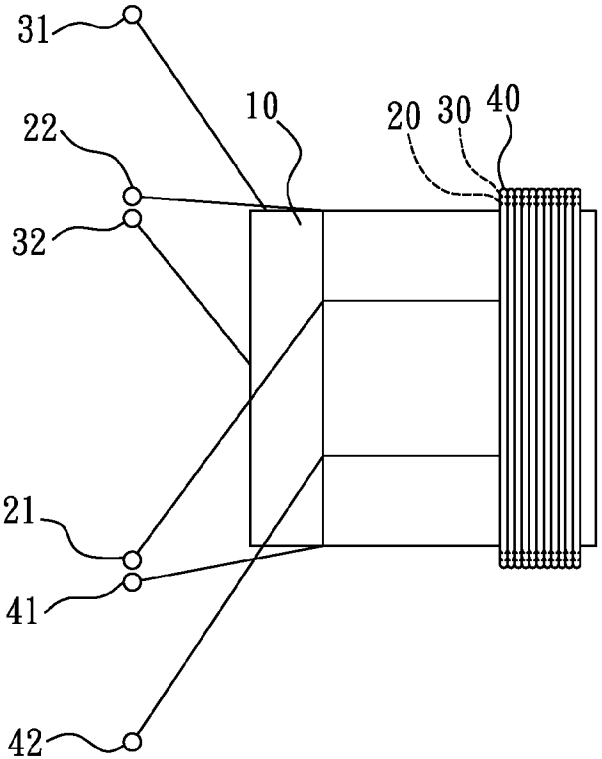
FIG. 3*a* illustrates a side view of an improved speaker voice coil structure according to a preferred embodiment of the present invention.

Please refer to FIG. 3*a* and FIG. 3*b*, which illustrate respectively a side view and a top view of an improved speaker voice coil structure according to a preferred embodiment of the present invention. As is illustrated in the figures, the improved voice coil structure of the present invention includes: a bobbin 10, a first voice coil 20, a second voice coil 30, and a third voice coil 40.

In the structure, the bobbin 10 is used for the winding of the first voice coil 20, the second voice coil 30, and the third voice coil 40. As the bobbin 10 is a well known component and not the focus of the present invention, it will not be addressed further.

The first voice coil 20 is made of copper wire, of which the diameter can be adjusted according to requirement, and is wound around the bobbin 10 with multiple turns—for example but not limited to 2~4 turns. The first voice coil 20 has a first terminal 21 and a second terminal 22, wherein the angle between the first terminal 21 and the second terminal 22 seen from the center of the bobbin 10 is about 60°.

The second voice coil 30 is also made of copper wire, of which the diameter can be adjusted according to requirement, and is wound around the first voice coil 20 with multiple turns—for example but not limited to 2~4 turns. The second voice coil 30 has a third terminal 31 and a fourth terminal 32, wherein the angle between the third terminal 31 and the fourth terminal 32 seen from the center of the bobbin 10 is about 60°.

The third voice coil 40 is also made of copper wire, of which the diameter can be adjusted according to requirement, and is wound around the second voice coil 30 with multiple turns—for example but not limited to 2~4 turns. The third voice coil 40 has a fifth terminal 41 and a sixth terminal 42, wherein the angle between the fifth terminal 41 and the sixth terminal 42 seen from the center of the bobbin 10 is about 60°. By this arrangement, as illustrated in FIG. 3*b*, the first terminal 21, the second terminal 22, the third terminal 31, the fourth terminal 32, the fifth terminal 41, and the sixth terminal 42 can be located evenly apart from one another to prevent overlapping. Besides, the impedance between the first terminal 21 and the second terminal 22 of the first voice coil 20, the impedance between the third terminal 31 and the fourth terminal 32 of the second voice coil 30, and the impedance between the fifth terminal 41 and the sixth terminal 42 of the third voice coil 40 are all independent—for example, each of the three can be determined independently to be 2 or 4Ω. In this embodiment, 2Ω for all of the three is taken for the convenience of illustration and the present invention is not intended to be limited thereto.

As the arrangement of the first voice coil 20, the second voice coil 30, and the third voice coil 40 of the voice coil structure for speaker of the present invention can minimize the space occupied by the three voice coils, the situation of wire slipping off the bobbin can therefore be prevented.

Figure 4:
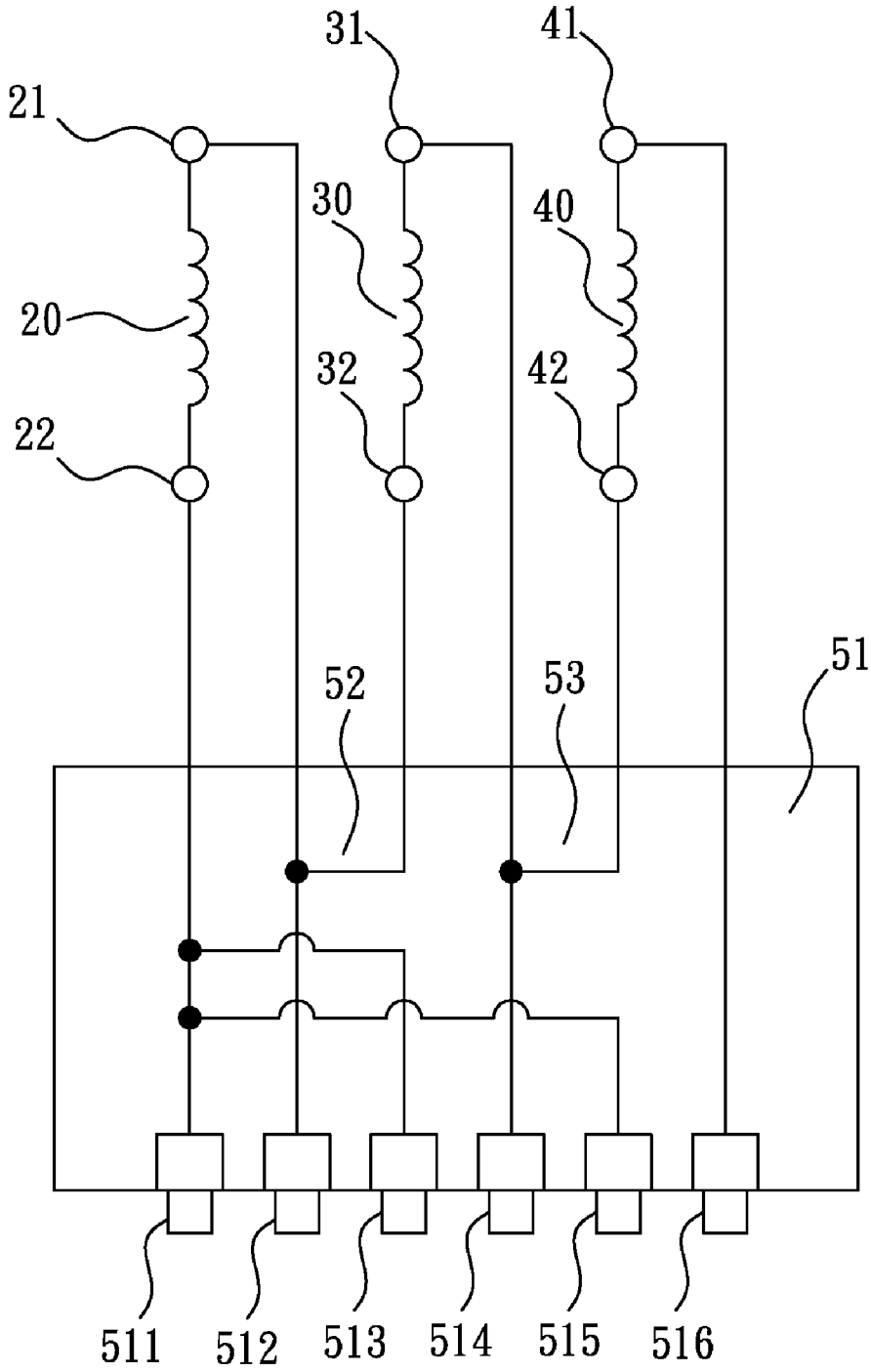
FIG. 4 illustrates an improved speaker voice coil structure further including a printed circuit board and two connection devices according to a preferred embodiment of the present invention.

Please refer to FIG. 4, which illustrates an improved speaker voice coil structure further including a printed circuit board and two connection devices according to a preferred embodiment of the present invention. As is illustrated in the figure, the improved speaker voice coil structure further includes: a printed circuit board 51; a first connection device 52; and a second connection device 53.

The printed circuit board 51 has at one side a first terminal block 511, a second terminal block 512, a third terminal block 513, a fourth terminal block 514, a fifth terminal block 515, a sixth terminal block 516, wherein the first terminal block 511 is coupled to the second terminal 22, the second terminal block 512 is coupled to the first terminal 21, the third terminal block 513 is coupled to the second terminal 22, the fourth terminal block 514 is coupled to the third terminal 31, the fifth terminal block 515 is coupled to the second terminal 22, and the sixth terminal block 516 is coupled to the fifth terminal 41, such that an impedance of 2Ω can be provided between the first terminal block 511 and the second terminal block 512.

The first connection device 52 is placed on the printed circuit board 51 and used to connect the first terminal 21 with the fourth terminal 32, so that the first voice coil 20 and the second voice coil 30 connect in series, and an impedance of 4Ω can be provided between the third terminal block 513 and the fourth terminal block 514.

The second connection device 53 is placed on the printed circuit board 51 and used to connect the third terminal with the sixth terminal, so that the first voice coil 20, the second voice coil 30, and the third voice coil 40 connect in series, and an impedance of 6Ω can be provided between the fifth terminal block 515 and the sixth terminal block 516. As such, the improved speaker voice coil structure provides impedance options for users. For example, if the output impedance of an amplifier is 2Ω, users can use conduction cables (not shown in the figure) to connect the output terminals of the amplifier (not shown in the figure) to the first terminal block 511 and the second terminal block 512, so as to attain impedance matching between the amplifier and the speaker, and thereby maximize power transformation.

In addition, if the output impedance of an amplifier is 4Ω, users can use conduction cables (not shown in the figure) to connect the output terminals of the amplifier (not shown in the figure) to the third terminal block 513 and the fourth terminal block 514; and if the output impedance of an amplifier is 6Ω, users can use conduction cables (not shown in the figure) to connect the output terminals of the amplifier (not shown in the figure) to the fifth terminal block 515 and the sixth terminal block 516. By such arrangements, the impedance matching between the amplifier and the speaker can be attained, and power transformation can be maximized. Therefore, the improved speaker voice coil structure of the present invention offers: 1. multiple options of connection terminals for an input signal; 2. multiple options of connection terminals from different layers; 3. multiple options of impedance; and 4. better arrangement of voice coils for minimizing the space occupied by the coils to prevent wire of the coils from slipping off a bobbin. As such, the present invention dose improve the prior art speaker voice coil structure.

Figure 5:
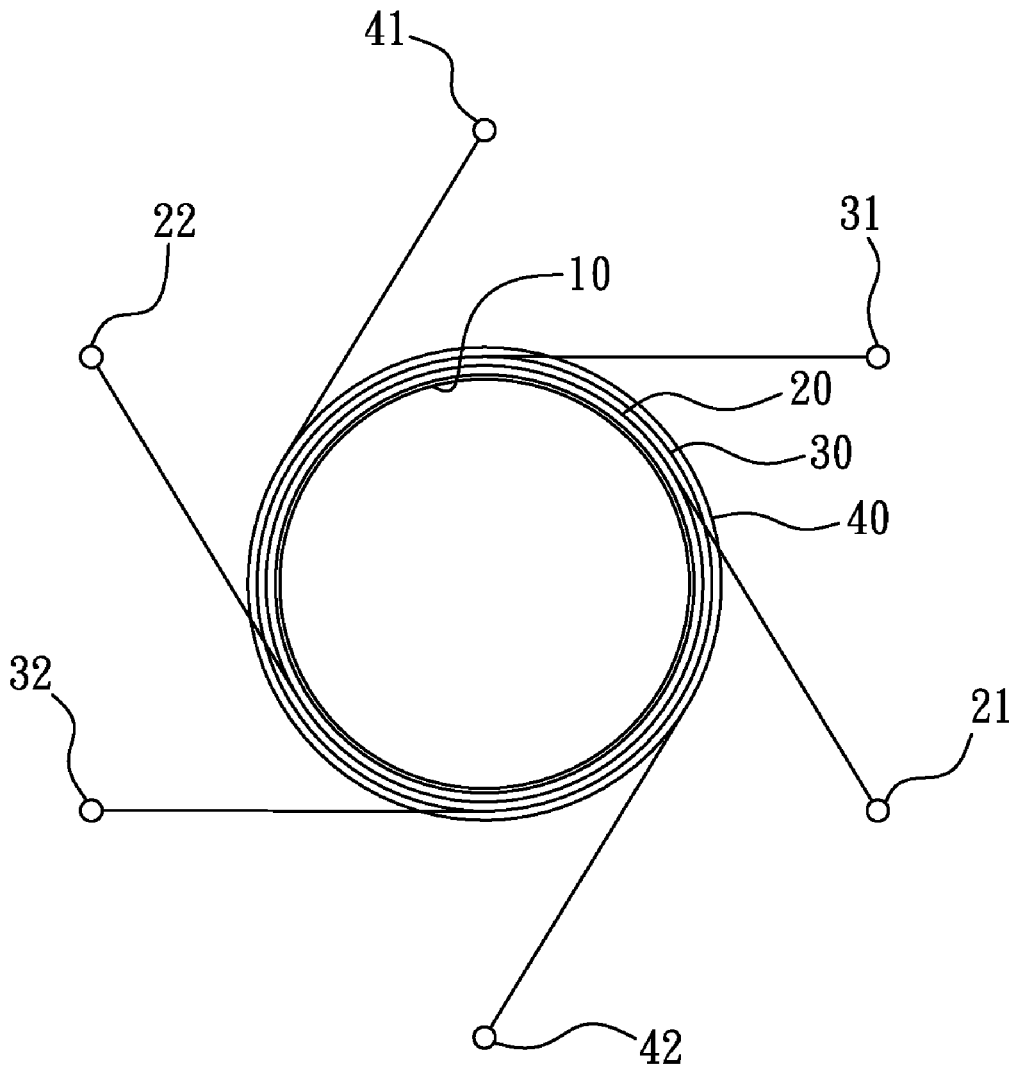
FIG. 5 illustrates an improved speaker voice coil structure according to another preferred embodiment of the present invention.

Please refer to FIG. 5, which illustrates an improved speaker voice coil structure of the present invention according to another preferred embodiment. As illustrated in the figure, the first terminal 21 and the second terminal 22 of the first voice coil 20 are disposed in opposite directions rather than 60° seen from the center of the bobbin 10 as illustrated in FIG. 3*b*; the third terminal 31 and the fourth terminal 32 of the second voice coil 30 are also disposed in opposite directions, and both of the angle between the third terminal 31 and the first terminal 21 seen from the center of the bobbin 10, and the angle between the fourth terminal 32 and the second terminal 22 seen from the center of the bobbin 10 is equal to a first angle—for example but not limited to 120°; the fifth terminal 41 and the sixth terminal 42 of the third voice coil 40 are also disposed in opposite directions, and both of the angle between the fifth terminal 41 and the third terminal 31 seen from the center of the bobbin 10, and the angle between the sixth terminal 42 and the fourth terminal 32 seen from the center of the bobbin 10 is equal to a second angle—for example but not limited to 120°. By this arrangement, the first terminal 21, the second terminal 22, the third terminal 31, the fourth terminal 32, the fifth terminal 41, and the sixth terminal 42 can also be located evenly apart from one another to prevent overlapping. In conclusion, the improved speaker voice coil structure of the present invention offers: 1. multiple options of connection terminals for an input signal; 2. multiple options of connection terminals from different layers; 3. multiple options of impedance; and 4. better arrangement of voice coils for minimizing the space occupied by the coils to prevent wire of the coils from slipping off a bobbin. As such, the present invention dose improve the prior art speaker voice coil structure.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. An improved speaker voice coil structure, comprising:

a bobbin;

a first voice coil, wound around said bobbin, and having a first terminal and a second terminal;

a second voice coil, wound around said first voice coil, and having a third terminal and a fourth terminal;

a third voice coil, wound around said second voice coil, and having a fifth terminal and a sixth terminal, wherein said first terminal, said second terminal, said third terminal, said fourth terminal, said fifth terminal, and said sixth terminal are approximately evenly separated with an angular distance seen from the center of said bobbin;

a printed circuit board, having at one side a first terminal block, a second terminal block, a third terminal block, a fourth terminal block, a fifth terminal block, and a sixth terminal block, wherein said first terminal block is coupled to said second terminal, said second terminal block is coupled to said first terminal, said third terminal block is coupled to said second terminal, said fourth terminal block is coupled to said third terminal, said fifth terminal block is coupled to said second terminal, and said sixth terminal block is coupled to said fifth terminal, such that an impedance of 2Ω or 4Ω is provided between said first terminal block and said second terminal block;

a first connection device, placed on said printed circuit board and used to connect said first terminal with said fourth terminal, such that an impedance of 4Ω or 8Ω is provided between said third terminal block and said fourth terminal block; and a second connection device, placed on said printed circuit board and used to connect said third terminal with said sixth terminal, such that an impedance of 6Ω or 12Ω is provided between said fifth terminal block and said sixth terminal block;

wherein said first voice coil, said second voice coil, and said third voice coil have 2 or 4 turns respectively;

wherein the impedance between said first terminal and said second terminal of said first voice coil, the impedance between said third terminal and said fourth terminal of said second voice coil, and the impedance between said fifth terminal and said sixth terminal of said third voice coil are independent to one another;

wherein the impedance between said first terminal and said second terminal of said first voice coil, the impedance between said third terminal and said fourth terminal of said second voice coil, and the impedance between said fifth terminal and said sixth terminal of said third voice coil are 2Ω or 4Ω.

2. The improved speaker voice coil structure as claim 1, wherein said angular distance is 60°.

3. An improved speaker voice coil structure comprising:

a bobbin;

a first voice coil, wound around said bobbin, and having a first terminal and a second terminal;

a second voice coil, wound around said first voice coil, and having a third terminal and a fourth terminal, wherein both of the angle between said third terminal and said first terminal seen from the center of said bobbin, and the angle between said fourth terminal and said second terminal seen from the center of said bobbin are equal to a first angle;

a third voice coil, wound around said second voice coil, and having a fifth terminal and a sixth terminal, wherein both of the angle between said fifth terminal and said third terminal seen from the center of said bobbin, and the angle between said sixth terminal and said fourth terminal seen from the center of said bobbin are equal to a second angle;

a printed circuit board, having at one side a first terminal block, a second terminal block, a third terminal block, a fourth terminal block, a fifth terminal block, and a sixth terminal block, wherein said first terminal block is coupled to said second terminal, said second terminal block is coupled to said first terminal, said third terminal block is coupled to said second terminal, said fourth terminal block is coupled to said third terminal, said fifth terminal block is coupled to said second terminal, and said sixth terminal block is coupled to said fifth terminal, such that an impedance of 2Ω or 4Ω is provided between said first terminal block and said second terminal block;

a first connection device, placed on said printed circuit board and used to connect said first terminal with said fourth terminal, such that an impedance of 4Ω or 8Ω is provided between said third terminal block and said fourth terminal block; and a second connection device, placed on said printed circuit board and used to connect said third terminal with said sixth terminal, such that an impedance of 6Ω or 12Ω is provided between said fifth terminal block and said sixth terminal block;

wherein said first voice coil, said second voice coil, and said third voice coil have 2 or 4 turns respectively;

wherein the impedance between said first terminal and said second terminal of said first voice coil, the impedance between said third terminal and said fourth terminal of said second voice coil, and the impedance between said fifth terminal and said sixth terminal of said third voice coil are independent to one another;

wherein the impedance between said first terminal and said second terminal of said first voice coil, the impedance between said third terminal and said fourth terminal of said second voice coil, and the impedance between said fifth terminal and said sixth terminal of said third voice coil are 2Ω or 4Ω.

4. The improved speaker voice coil structure as claim 3, wherein said first angle and said second angle are both 120°.

* * * * *